US010434360B1

(12) United States Patent
Hosfeld

(10) Patent No.: US 10,434,360 B1
(45) Date of Patent: Oct. 8, 2019

(54) MULTI-JOINT EXERCISE MACHINE

(71) Applicant: Eric Hosfeld, Gahanna, OH (US)

(72) Inventor: Eric Hosfeld, Gahanna, OH (US)

( * ) Notice: Subject to any disclaimer, the term of this patent is extended or adjusted under 35 U.S.C. 154(b) by 160 days.

(21) Appl. No.: 15/291,532

(22) Filed: Oct. 12, 2016

Related U.S. Application Data

(60) Provisional application No. 62/240,357, filed on Oct. 12, 2015.

(51) Int. Cl.

| | |
|---|---|
| ***A63B 21/062*** | (2006.01) |
| ***A63B 21/00*** | (2006.01) |
| ***A63B 21/22*** | (2006.01) |
| ***A63B 23/04*** | (2006.01) |

(52) U.S. Cl.
CPC ..... *A63B 21/0628* (2015.10); *A63B 21/155* (2013.01); *A63B 21/22* (2013.01); *A63B 21/4047* (2015.10); *A63B 23/0494* (2013.01); *A63B 2225/09* (2013.01)

(58) Field of Classification Search
CPC ..... A63B 21/0615–0632; A63B 21/154–156; A63B 21/4049; A63B 23/0405–2023/0452
See application file for complete search history.

(56) References Cited

U.S. PATENT DOCUMENTS

| | | | | |
|---|---|---|---|---|
| 3,858,873 | A | 1/1975 | Jones | |
| 4,176,836 | A | 12/1979 | Coyle | |
| 4,511,137 | A | 4/1985 | Jones | |
| 4,836,536 | A | 6/1989 | Jones | |
| 4,858,919 | A | 8/1989 | Jones | |
| 4,875,676 | A | 10/1989 | Zimmer | |
| 5,344,374 | A * | 9/1994 | Telle | A63B 21/00072 482/112 |
| 5,411,458 | A | 5/1995 | Giust | |
| 5,597,375 | A | 1/1997 | Simonson | |
| 5,616,111 | A | 4/1997 | Randolph | |
| 5,885,193 | A | 3/1999 | Habing et al. | |
| 6,364,815 | B1 * | 4/2002 | Lapcevic | A63B 21/0615 482/100 |
| 6,746,378 | B2 | 6/2004 | Morris et al. | |
| 7,052,446 | B2 | 5/2006 | Morris et al. | |
| 7,645,216 | B2 | 1/2010 | Edeker | |

(Continued)

FOREIGN PATENT DOCUMENTS

| | | | |
|---|---|---|---|
| GB | 2223686 | A | 4/1990 |

*Primary Examiner* — Jennifer M Deichl
(74) *Attorney, Agent, or Firm* — The Law Office of Patrick F. O'Reilly III, LLC

(57) ABSTRACT

The present invention relates to a machine providing a compound leg exercise known as a squat. The purpose of the invention is to provide rotational resistance to the muscles and joints in a compound exercise. The apparatus uses a cable connecting weights to a cam; the cam converts linear resistance to rotational resistance transferred to a driven gear, and then to a second axis and reversed by use of a drive gear meshed to the driven gear. Both gears are aligned to the joints involved in the exercise. Connected to the drive gear is a lever and footplate the user pushes against. The resulting resistance is perpendicular to the direction of force applied by the muscles and joints, while the feet move in a straight line. The present invention can be applied to compound exercises for the upper or lower body in a variety of different embodiments.

15 Claims, 15 Drawing Sheets

(56) References Cited

U.S. PATENT DOCUMENTS

| | | | | |
|---|---|---|---|---|
| 7,947,004 | B2 | 5/2011 | Kazerooni et al. | |
| 2004/0116839 | A1 | 6/2004 | Sarkodie-Gyan | |
| 2007/0037667 | A1 | 2/2007 | Gordon | |
| 2008/0153677 | A1 | 6/2008 | Webber et al. | |
| 2008/0207414 | A1* | 8/2008 | Cook ..... | A63B 21/0615 482/145 |
| 2010/0075817 | A1 | 3/2010 | Abdoli-Eramaki | |
| 2014/0057761 | A1 | 2/2014 | Higgins | |
| 2014/0336018 | A1 | 11/2014 | Thompson | |
| 2015/0016923 | A1 | 1/2015 | Brown | |

* cited by examiner

MULTI-JOINT EXERCISE MACHINE

CROSS-REFERENCE TO RELATED APPLICATIONS

This application claims priority to U.S. provisional application 62/240,357, filed Oct. 12, 2015, the entire contents of which are hereby incorporated by reference.

FIELD

The present invention relates generally to exercise equipment and specifically to exercise equipment for the performance of compound exercises comprising linear multi-joint exercises.

BACKGROUND

Compound exercises are multi-joint closed kinetic chain functional movements with several muscles working together. The compound exercises produce the greatest increases in muscle size and strength. This is due to the greater amounts of weight lifted and the large number of muscles involved. The movement of compound exercises consists primarily of pushing or pulling movements creating a substantially linear effect of distal motion such as in the hands or feet. However, the straight line movement is created by joints which can only rotate. The body can create a straight line movement by the combined movement of two joints rotating in opposite directions. This cancels out the rotational effect to form a straight line. Compound exercises include but are not limited to squat, bench press, press, row, dip, pull down, etc.

Isolation exercises or open kinetic chain exercises are typically single joint movements that isolate single muscle groups from the rest of the body using lighter weights than is possible with compound exercises. Isolation exercises are considered to be high in shear stress on the joints. Also, they are not considered functional exercises in that many of the movements do not transfer to daily activities in which the muscles work together; not in isolation from the rest of the body. One advantage of isolation exercises is that these easily allow the use of rotational resistance about a single pivot providing a full range of motion and even distribution of resistance not possible with conventional compound exercises.

Linear resistance creates shear stress caused by rotating joints opposing linear resistance. This creates both high shear force and sticking points when the limbs are perpendicular to the load as well as producing insufficient muscle stimulus during the exercise movement as resistance progressively diminishes due to improving mechanical advantage as they approach parallel to the resistance. Arthur Jones Nautilus machines provided a solution with machines that provided rotational resistance to the muscles by rotating the resistance coaxially to the same axes of rotation as the joints. Many single joint isolation machines now incorporate this method to provide rotational resistance to single muscle groups.

Attempts to solve the problems of compound exercises have focused on supplying resistance to the primarily linear distal movement of the hands or feet rather than to the movement of the joints creating that movement. This results in shear stress on the joints when the limbs are in a horizontal position relative to the load. Sled type leg press, single pivot lever arm machines, even 4 bar linkage machines as well as cable machines only produce a linear, convex, concave, or modified mixture of the two. Most of the foregoing conventional systems attempt to mimic the natural distal motion of the hands or foot movement through the exercise, rather than the movement of the joints during the exercise. Previous attempts to reduce shear stress focus solutions to the location of the discomfort rather than to the cause. Some of these attempted solutions include knee wraps and weight belts for squats, leg press machines in which the lumbar is pressed against a back rest with body maintaining a seated position and the legs extending out in front of the body, allowing the knee angle to be reduced to reduce knee shear stress. This compresses the body while not allowing the hips to fully extend and so can be uncomfortable as well as not a functional movement. A commonly advised solution is to use light weights. This works to reduce shear stress on the knees and lumbar but also removes most of the beneficial muscle stimulus.

SUMMARY

It is an object of the present invention to provide a machine that keeps all the substantial benefits of a compound exercise, while eliminating the considerable disadvantages of these exercises.

It is an object of the present invention to minimize the need for separate isolation machines to work individual muscles with single joint exercises because the rotational resistance and full range of motion previously only available on single joint isolation machines is provided for the muscles of both joints in a compound exercise machine.

It is an object of the present invention to provide a novel and improved, user defined, path of motion. Although the intended function and purpose of the machine is to provide an improved compound exercise, this is not to limit its application, as an unexpected benefit of the design permits the same machine(s) to provide superior isolation exercise options without any modifications; even allowing the user to switch back and forth between an isolation and a compound exercise during the same set simply by the user simply restricting the movement of one joint while rotating the other joint to do the work and effectively dividing the exercise into it component parts. In other words, the user can freely move in two axis during the exercise movement.

Some of the isolation exercises possible using the resistance apparatus for various embodiments of compound machines include but are not limited to, pulldowns with pullovers and curls, with squats, stiff leg dead lifts/hyperextensions, etc.

An additional improvement over many conventional isolation machines is that the resistance can be applied through conventional natural handles and foot plates unlike many machines in which the resistance is often applied to the exerciser through padded lever arms resting against the sides front or back of a exercisers arms or legs in a way not normally used in daily activities and which is often uncomfortable.

It is an object of the present invention to provide a convenient pin selectable weight system to a squat exercise that can be started from the bottom squat position without undue strain on the joints. Several existing squat machines use plate loaded or stacking weights on the machine by hand to allow users to start the squat in the standing position. This is because it is very much harder starting in the bottom position of a squat with many present machines. However, the present invention squat is no more or less difficult to lift in the bottom position than in any other position, so using a convenient pin selected weight does not cause the exercise to be harder to start.

Although the machine is not attached to the body between the seat and the footplate, the direction of the application of resistance matches and opposes the direction of the line of force of the body. This eliminates the changing leverage inherent to linear resistance.

It is an object of the present invention to provide rotational resistance available on isolation exercise machines to a compound exercise machine.

DETAILED DESCRIPTION

Figure 1:
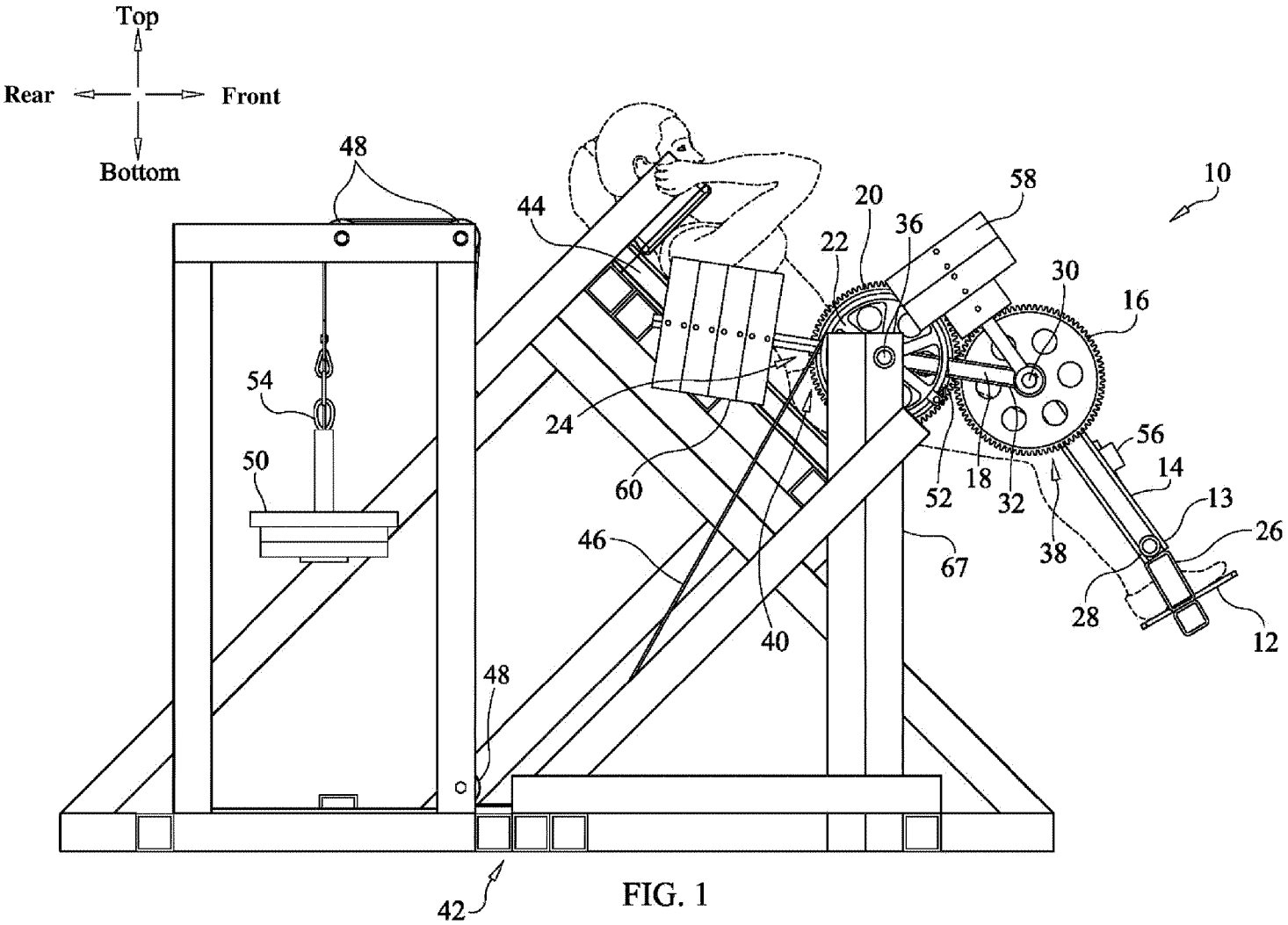
FIG. 1 depicts a side elevation view of an exercise machine shown with the user's legs extended according to an embodiment of the present invention.
Figure 2:
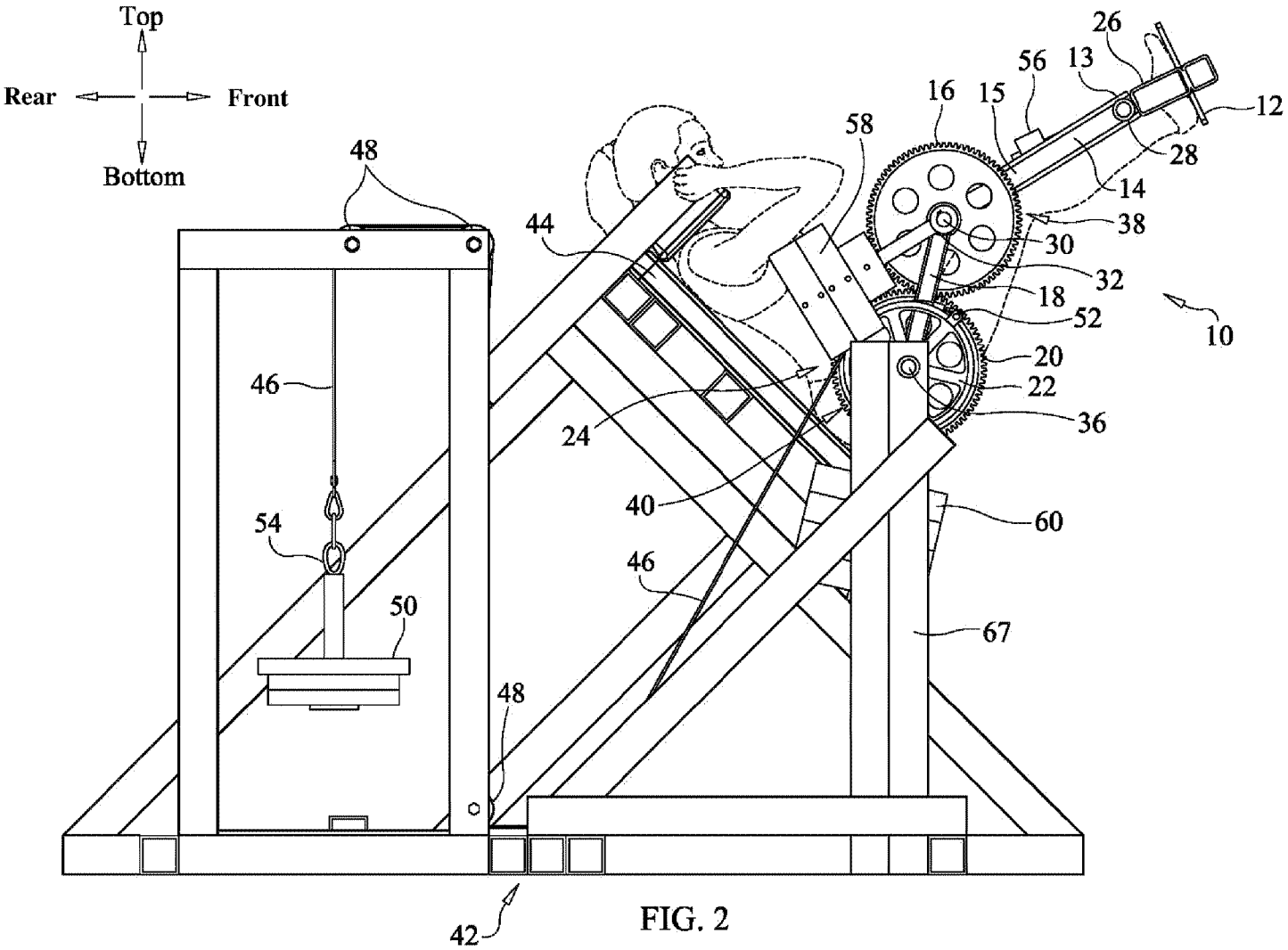
FIG. 2 depicts a side elevation view of the exercise machine of FIG. 1 shown with the user's legs elevated.
Figure 3:
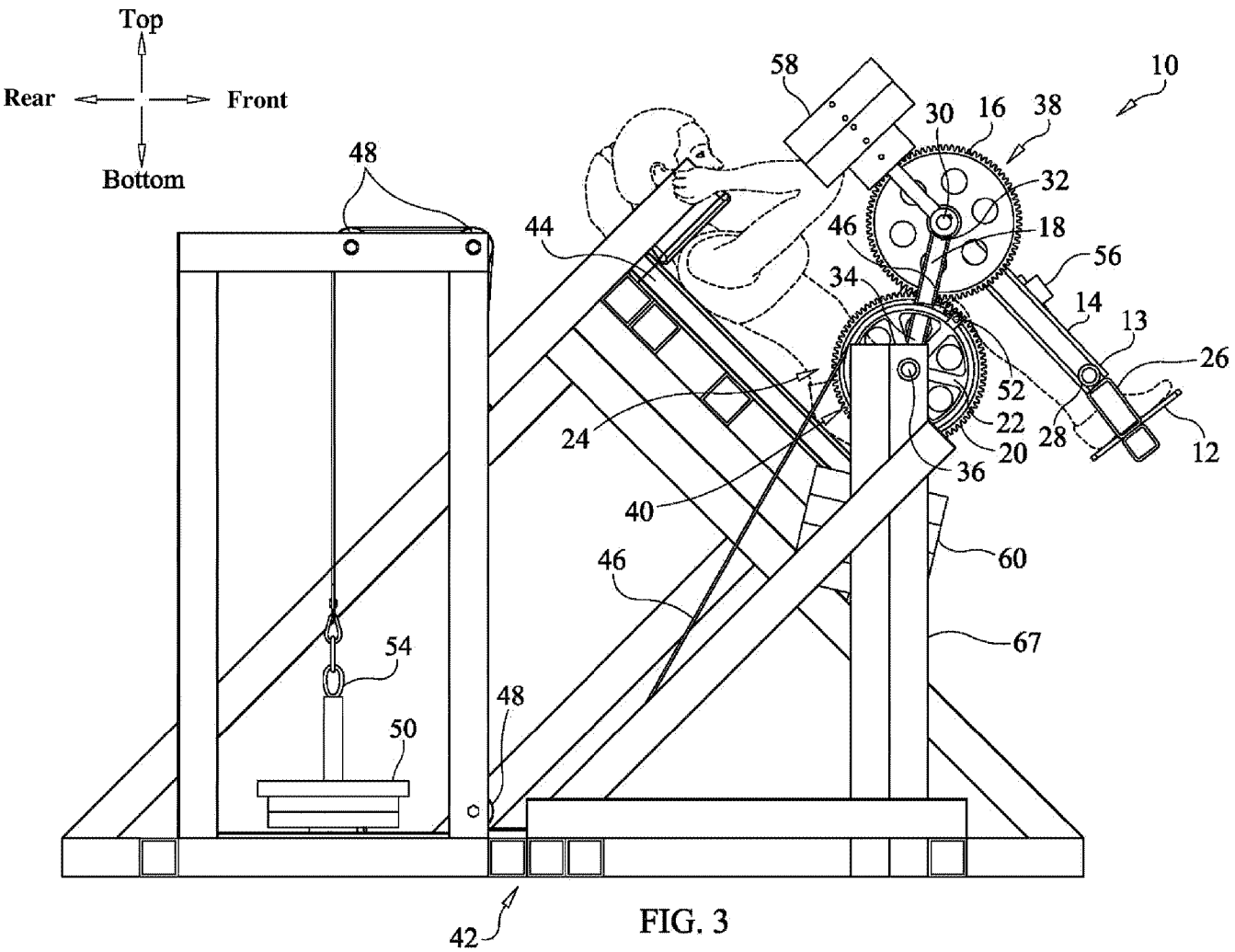
FIG. 3 depicts a side elevation view of the exercise machine of FIG. 1 shown with the user's legs retracted.
Figure 4:
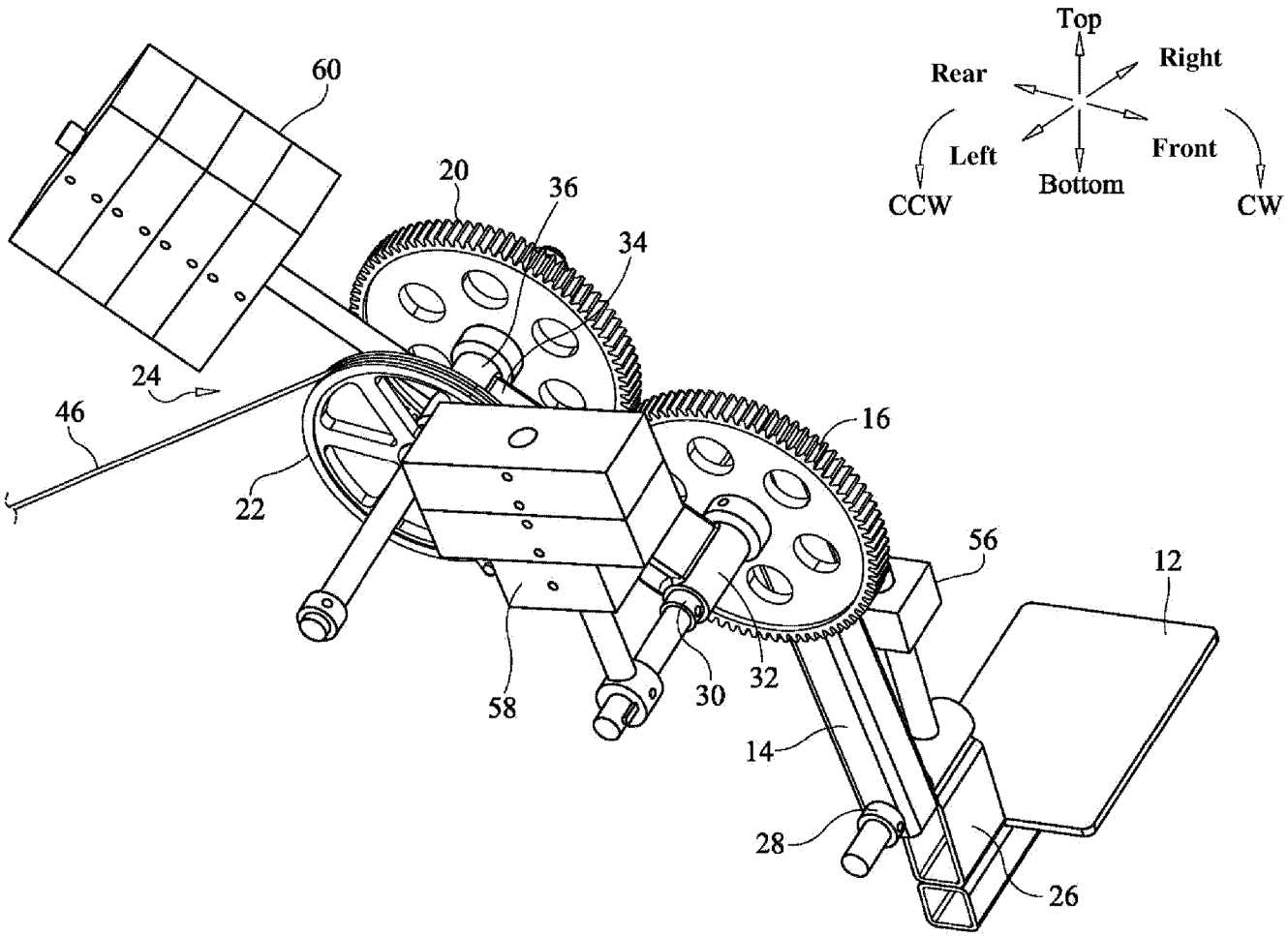
FIG. 4 depicts a side perspective view of the main moving parts of the exercise machine of FIG. 1.
Figure 5:
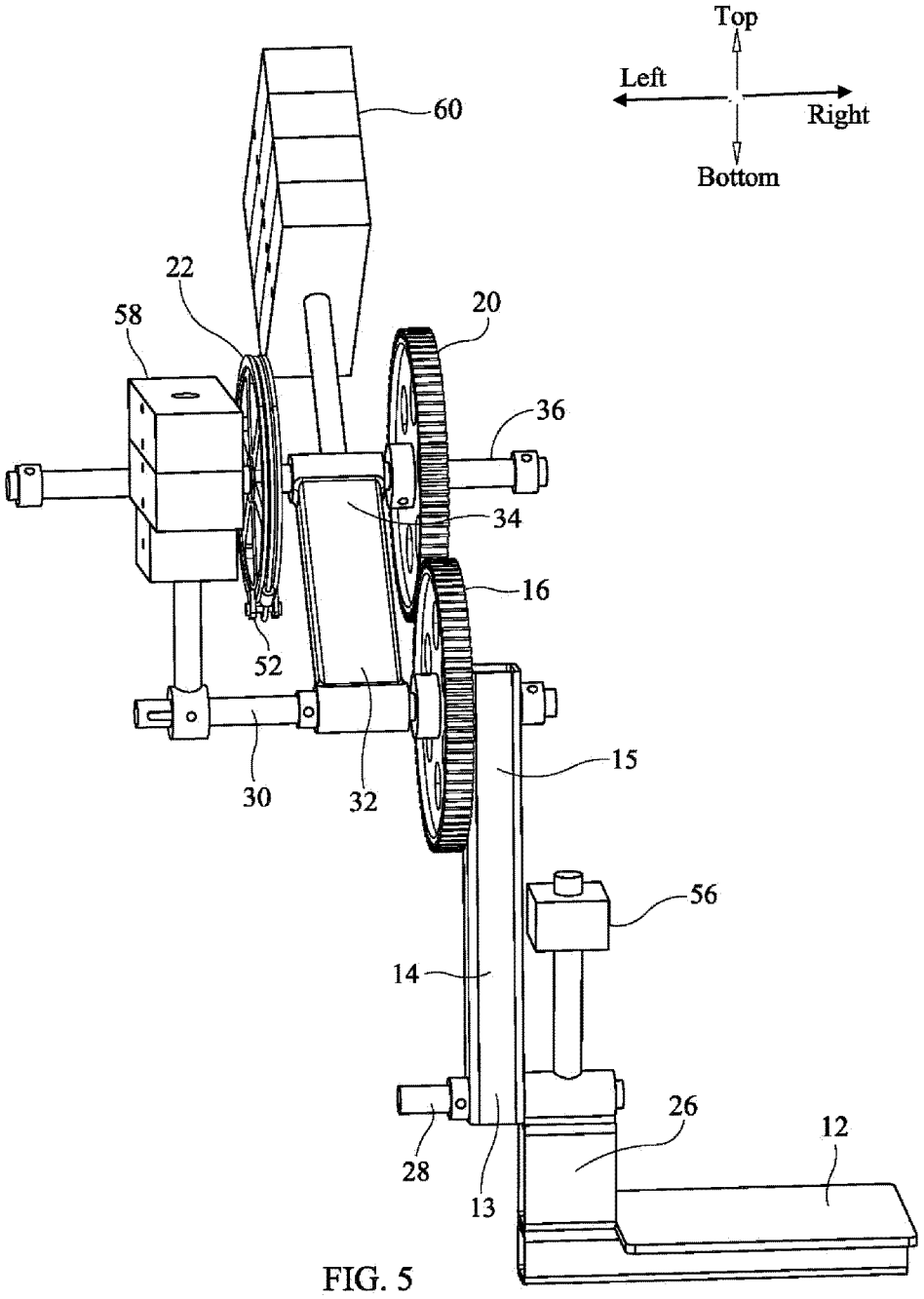
FIG. 5 depicts a front perspective view of the main moving parts of the exercise machine of FIG. 1.
Figure 6:
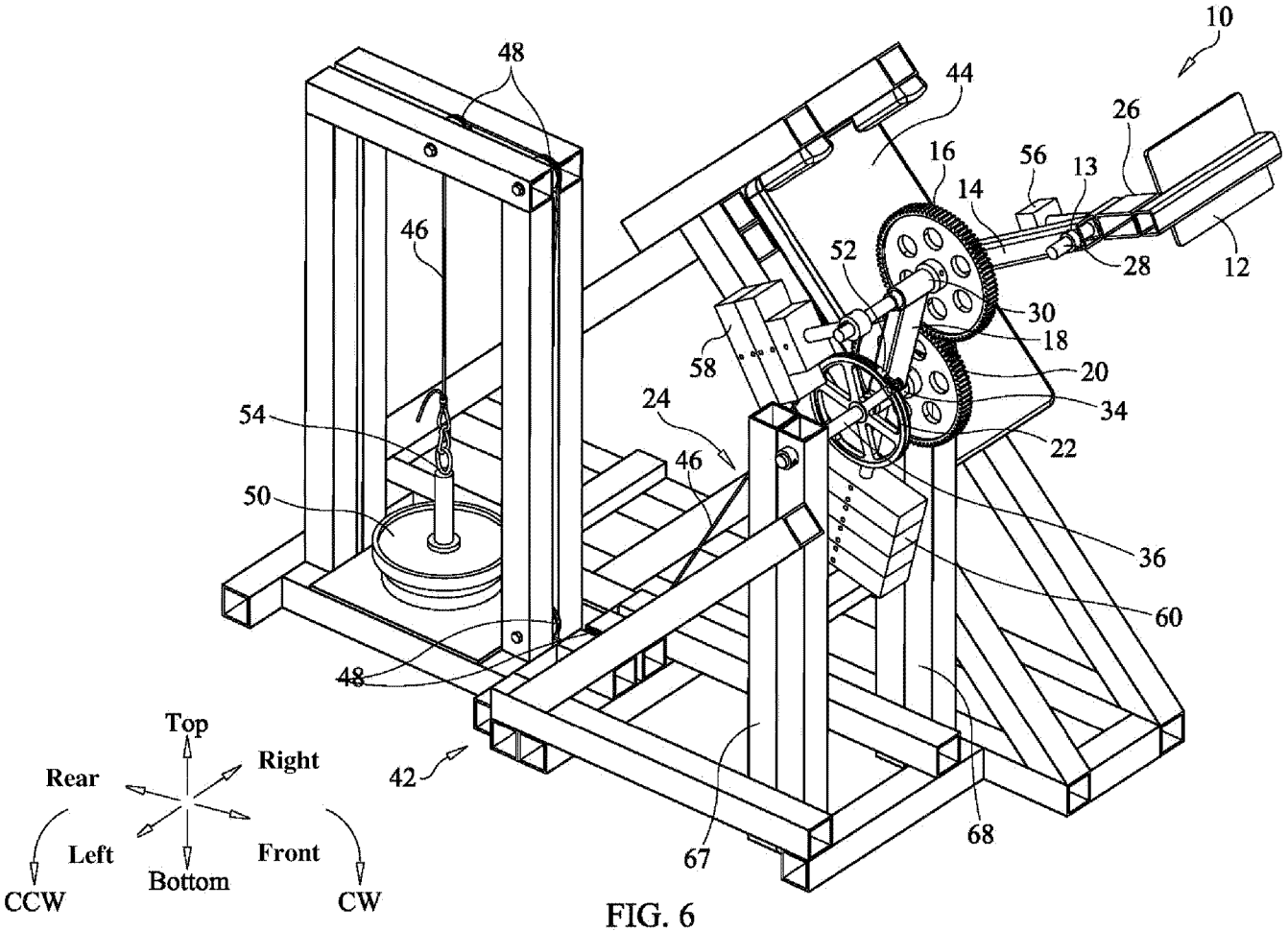
FIG. 6 depicts a side perspective view of the exercise machine of FIG. 1 shown without the user.

In the discussion that follows, like reference numerals are used to refer to like structures and elements in the various figures and embodiments. Furthermore, the elements in the various figures are not necessarily to scale.

The general arrangement of an exercise machine 10 for strengthening adjacent muscle groups in multi-joint compound exercises is shown in FIGS. 1 through 5 according to one embodiment of the present invention. Exercise machine 10 includes an engagement member 12, crank arm 14, a first cooperating member 16 (aka drive member, or gear), a connecting arm 18, a second cooperating member 20 (aka driven member, or gear), a cam 22, and a resistance or opposition system 24. An important novel aspect of the present invention relates to the cooperating members (a.k.a. drive member 16 and driven member 20) (shown as external spur gears) rotate in opposite directions, and this can be achieved in various embodiments and combinations by gears, chains, sprockets, belts, pulleys, cables, cords, ropes, rods, or other suitable devices known to those of skill in the art. Two preferred embodiments consist of external spur gears and serpentine chain drive. The preferred embodiment represents a 1:1 gear ratio, although uneven gear ratios may be used to increase or decrease resistance, or to limit the rotation of the cam on exercises with a larger range of motion, or to increase speed of rotation or power output, etc. Spur gears may have a standardized fixed center distance to accommodate a variety of users. As the length of the upper leg accounts for less than one quarter of a person's height, the acceptable range of pivot, knee, hip alignment may vary by approximately an inch. The same gear center distance may be comfortably used by people of varying heights. The other two sections of the machine, crank arm 14 and body support (aka back rest) 44, can be easily adjusted similarly to other machines known to those skilled in the art. The center distance for upper body exercises may similarly be standardized. Possible center distance and gear diameter may be approximately 16 inches for lower body exercises and approximately 12 inches for upper body exercises.

Figure 7A:
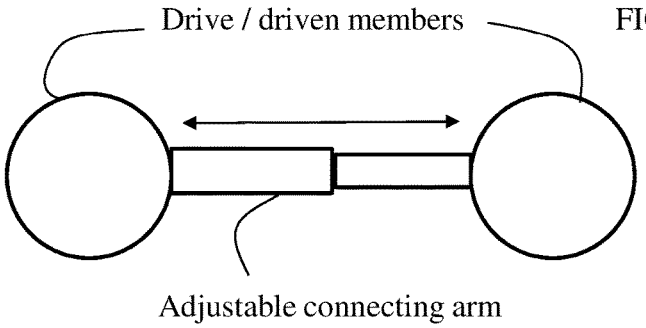
FIGS. 7A and 7B depict schematic diagrams of a serpentine chain-sprocket drive with adjustable connecting arm according to an alternative embodiment of the present invention.
Figure 7B:
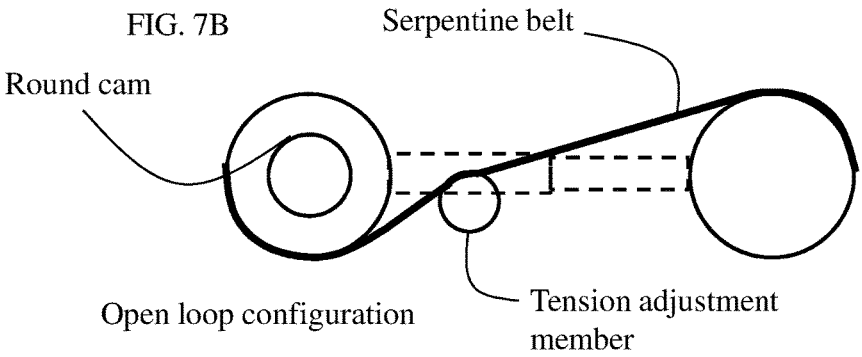
Figure 7C:
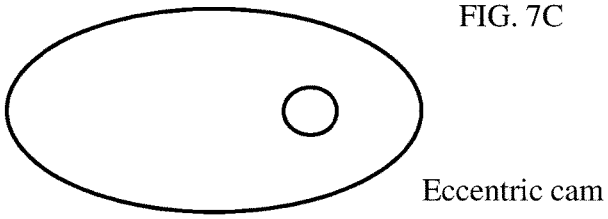
FIG. 7C depicts a schematic diagram of an eccentric cam according to an alternative embodiment of the present invention.

The other preferred drive mechanism consists of a serpentine chain drive (see FIGS. 7A, 7B) (aka serpentine connector) which can replace gears by looping under one sprocket and over the other or vice versa. This has the effect of oppositely rotating drive/driven members. There are other benefits such as strength, low maintenance, nonslip, less noise, and allowing an adjustable connecting arm 18. Because compound exercises require less than a full gear rotation, an open loop chain drive can be substituted for the closed loop chain drive typical of machines requiring full rotation. The open loop may be fixed to the drive member at one end and loop or wind, in a serpentine manner, around the other drive member (e.g. sprocket). The other end may be secured to the driven member (operatively connected to an opposing force. e.g. weight resistance) or wound around it. In embodiments incorporating the aforementioned adjustable connecting arm 18, a tension adjustment member (FIG. 7B), or spring loaded idler sprocket or gear is utilized, coupled with the telescoping connecting arm and adjustable fasteners. If opposite ends are securely fastened to the drive and driven members, or drive member at one end and weight at the other, then belts and pulleys may replace chains and sprockets.

Engagement member 12 can be a handle, hand grips, foot cradles, a foot plate (shown in FIGS. 1-5) or a pad configured as a point of contact with the human user-supplied force. Force exerted through the user's feet (or hands in other embodiments) against engagement member 12 initiates movement of exercise machine 10. Engagement member 12 is connected to a first end 13 of a crank arm 14, which is connected to drive member 16. As shown in FIG. 1, crank arm 14 is welded to drive member 16.

Figure 8A:
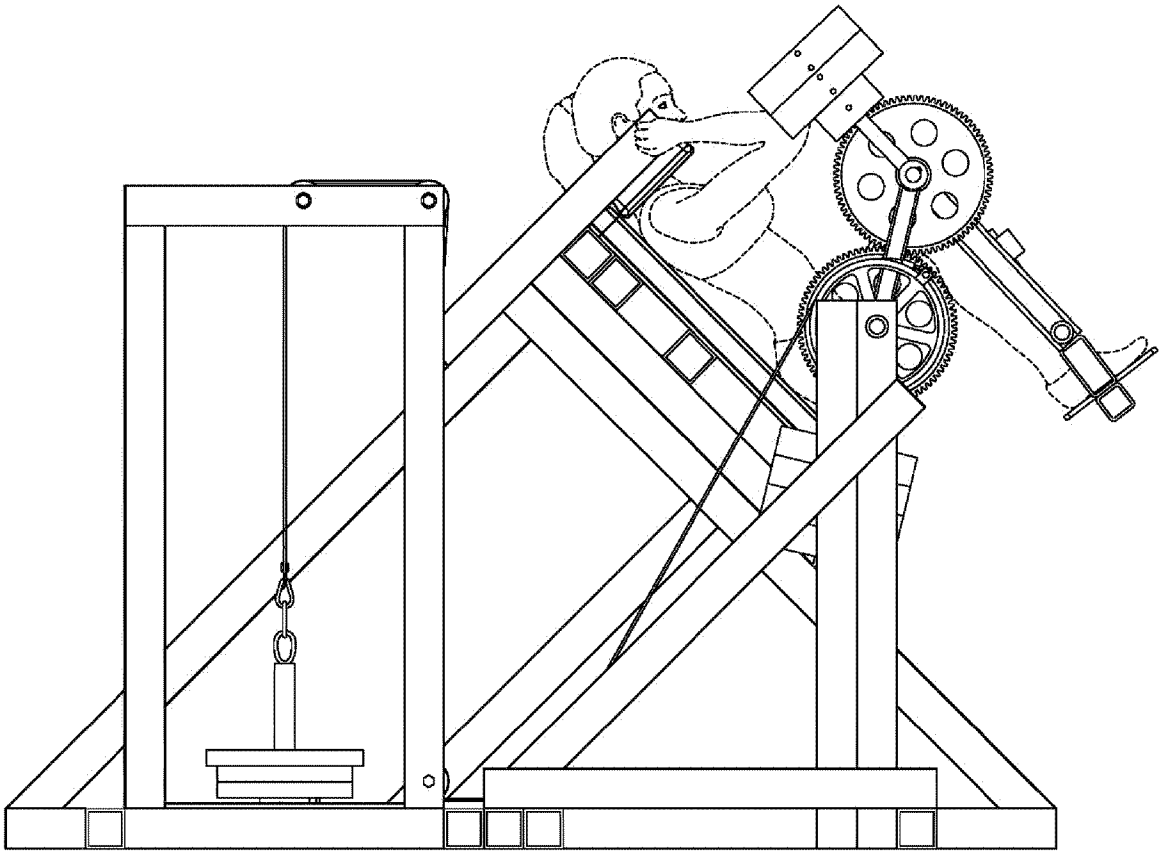
FIGS. 8A-C depict various positions of the exercise machine of FIG. 1 when used during a squat type of exercise.
Figure 8B:
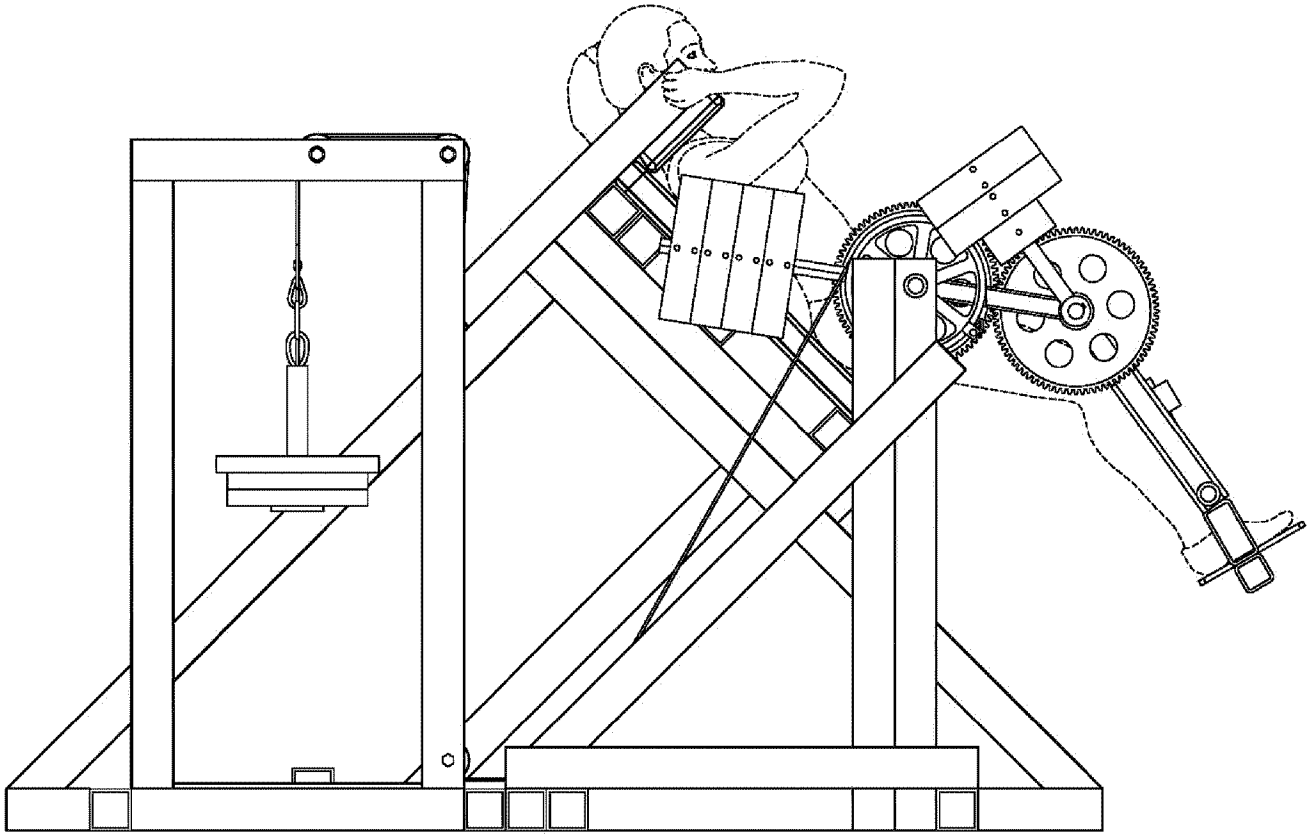
Figure 8C:
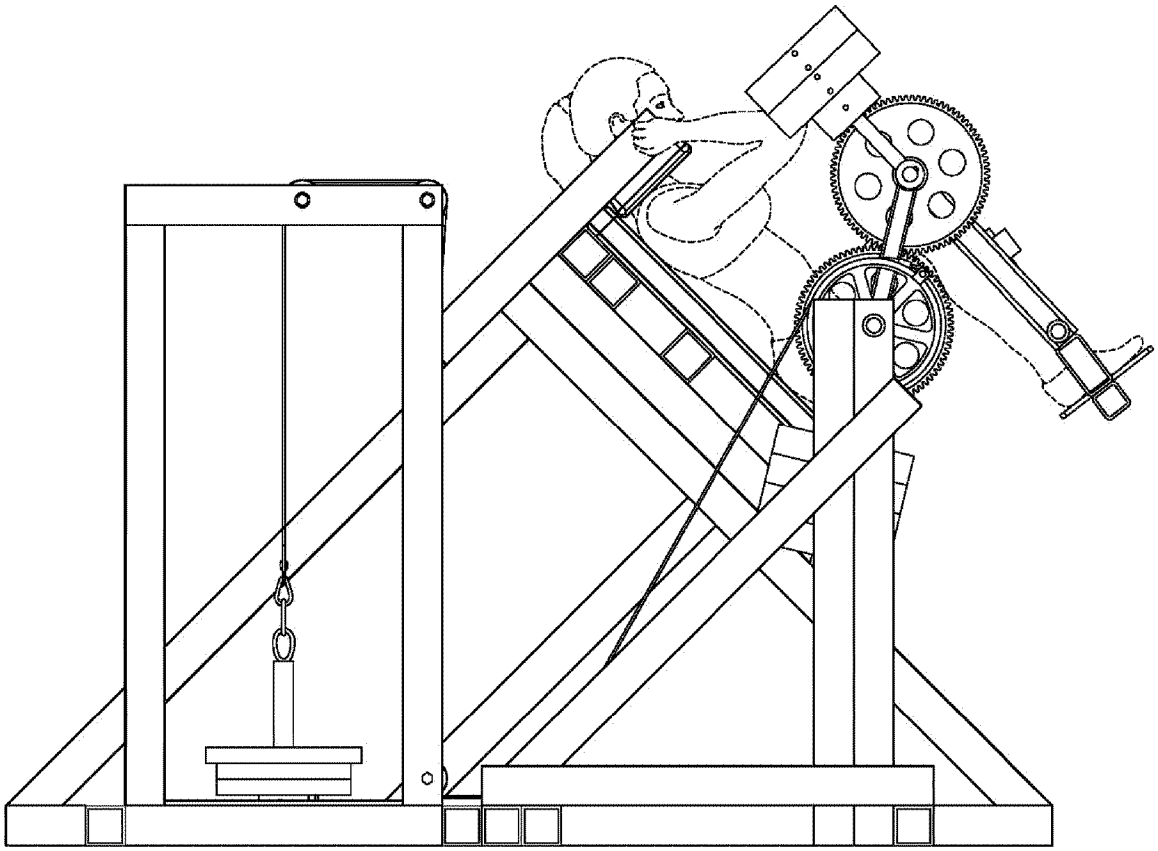

One advantage of the present invention is that engagement member 12 can be moved in a liner path, such as with a squat exercise (FIGS. 8A-C) or alternatively in an arcuate path (FIGS. 9A-C); in fact, the user can move relatively freely in two axes. FIGS. 8A-C depict a squat exercise wherein FIG. 8A depicts the starting position, after which engagement member 12 is moved linearly to the end position depicted in FIG. 8B, and finally returning to the starting position (FIG. 8A).

Figure 9A:
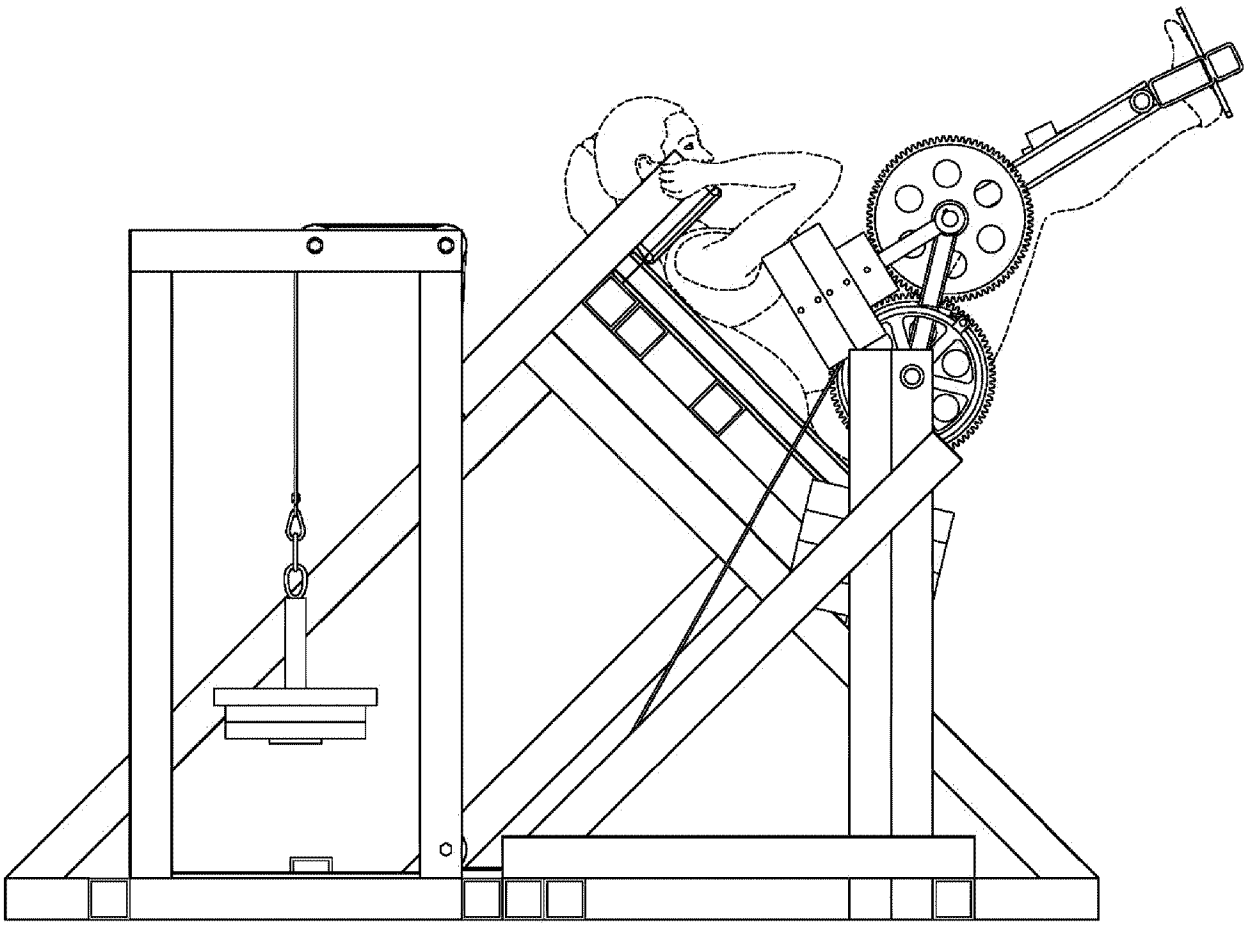
FIGS. 9A-C depict various positions of the exercise machine of FIG. 1 when used during a hip extension type of exercise.
Figure 9B:
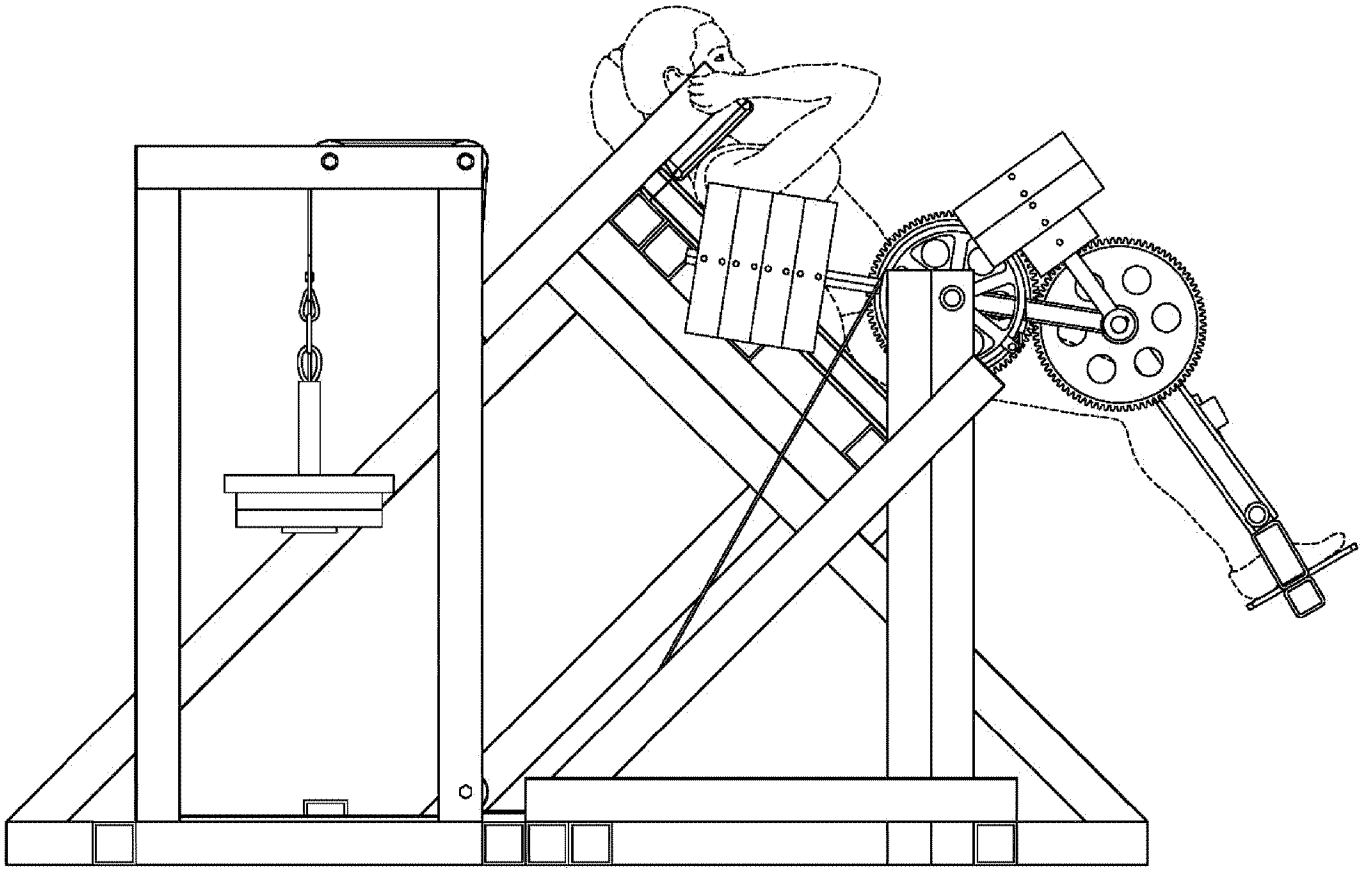
Figure 9C:
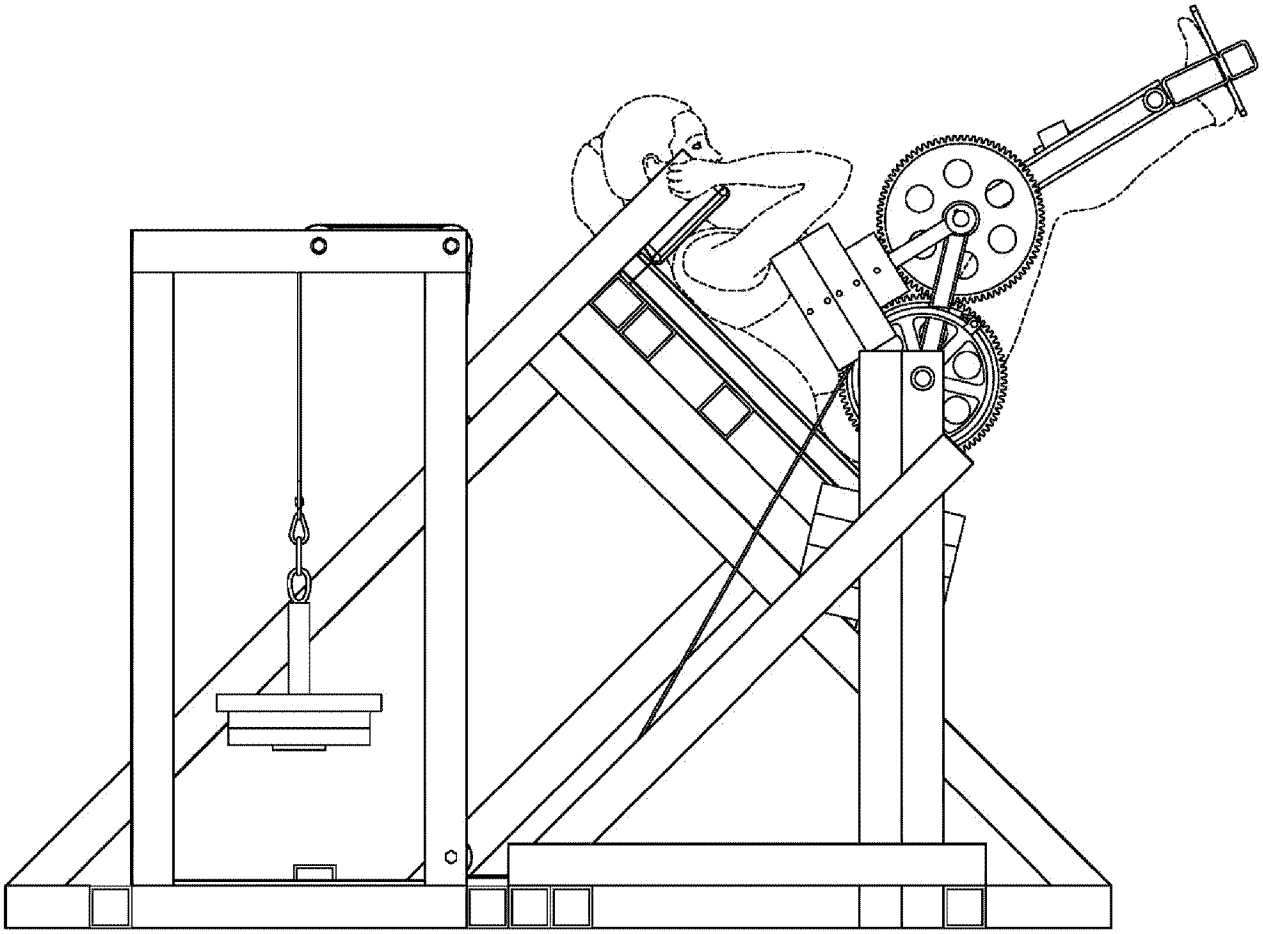

FIGS. 9A-C depict a "stiff leg dead lift" (aka hip extension) exercise wherein FIG. 9A depicts the starting position after which engagement member 12 is moved in an arcuate path to the end position depicted in FIG. 9B, and finally returning to the starting position (FIG. 9A).

Connection of engagement member 12 to crank arm 14 can be by either rigid or pivotable connection. As shown, engagement member 12 can include an extension 26 extending substantially perpendicularly to the engagement member on the left side and pivotably connected at pivot 28 to first end 13 of crank arm 14 (FIG. 1 depicts the connection on the right side of crank arm 14). The pivotal connection is achieved with a shaft through first end 13 of crank arm 14, and fixed relative thereto; engagement member 12 is connected to the shaft by a bearing.

In one embodiment, the distance from the bottom of engagement member 12 to the centerline of rotation for pivot 28 is about 5 inches. As such, pivot 28 aligns approximately coaxially with the ankle joint of the user. This pivotable arrangement at the user's ankle provides a more ergonomic cooperation with the user during performance of the exercise, and allows the user to maintain a more natural movement.

Crank arm 14 is an elongated member that can be adjustable in length to accommodate different arm and leg lengths of various users. The adjustment can include telescoping sections that are secured by a pin, fastener or suitable detent device. Second end 15 of crank arm 14 is operatively connected to drive member 16. In one embodiment, second end 15 of crank arm 14 is connected to the right side of drive member 16 by welding. Those of skill in the art will appreciate that other suitable fasteners can be used.

Drive member 16 is pivotably connected, via pivot shaft 30, to a first end 32 of connecting arm 18. In one embodiment, pivot shaft 30 extends from the left side of drive member 16. A second end 34 of connecting arm 18 is pivotably connected, via pivot shaft 36, to driven member 20. Pivot shaft 36 is connected, via bearings, to first and second pivot support posts 67, 68.

In one embodiment, pivot shaft 36 extends from the left side of driven member 20. Connecting arm 18 can include suitable bearings to provide for smooth rotation about pivot shafts 30, 36. In one embodiment, connecting arm 18 operates to hold drive member 16 and driven member 20 in a coplanar, meshed relationship to enable smooth interaction.

Driven member 20 is operatively connected to an opposing force. In one embodiment, driven member 20 is operatively connected to cam 22 at pivot shaft 36. Cam 22 is positioned coaxially with driven member 20. The central axis through driven member 20, pivot shaft 36 and cam 22 remains stationary relative to the user during operation of exercise machine 10. Cam 22 is connected to opposition system 24. Opposition system 24 provides the opposing force against which the user exercises. Drive member 16 and drive member counter weight 58 are both fixed to shaft 30 by keyway and setscrew, to balance at the pivot point. Driven member 20 and cam 22 are fixed to shaft 36 by keyway and setscrew to synchronize rotation. Bearings are used to achieve the foregoing connectivity. The location of pivoting members and fixed parts may be configured differently while still providing the desired result. During operation of exercise machine 10, the user positions a second joint 40 (e.g. hip) in approximate coaxial alignment with pivot shaft 36 of driven member 20.

Each of drive member 16 and driven member 20 are configured to provide opposing rotational resistance during a compound exercise movement performed by the user. Opposing rotational resistance occurs as the drive and driven members 16, 20 rotate in opposite directions. Drive and driven members 16, 20 are synchronized with respect to each other. This synchronization can be achieved by meshed gears or alternatively with chain & sprocket assemblies, belts, pulleys, etc. In one embodiment (FIG. 7B), an open loop serpentine belt is used. It should be noted that the invention can be used in some exercise movements that are not necessarily compound in nature. For example, the stiff leg dead lift (aka hip extension) described in associated with FIGS. 9A-9C.

Generally, in other applications of the present invention, such as exercises for the upper body, the drive member is aligned with a distal joint (e.g elbow) of the user's body closest to engagement member 12, where the movement of the exercise is initiated, while the driven member is aligned with the rotation of a proximal joint (e.g. shoulder) of the user's body.

Although a single gear set with arms is shown located on one side of the user, in some embodiments, a pair of opposing gear sets with arms can be located on both sides of the user for additional stability. Or for example, in compound exercise machines involving upper body movement, the motion of the mechanism is typically initiated by the user's hands transferring force against the engagement member 12 (i.e. handles). Engagement member 12 is connected to drive member 16, which is aligned approximately with the user's elbows. Driven member 20 is aligned approximately coaxially with the user's shoulders. For upper body exercise embodiments, the members/gears and cams can be located on both sides of the machine, each having separate handles to allow for each driven member 20 (one on either side) to coaxially align to each shoulder in a way not possible with a one-sided mechanism.

As shown, in a squat compound exercise application, first joint 38 is a knee joint and second joint 40 is a hip joint. As exercise machine 10 is operated, as the user pushes against engagement member 12 extending the legs away from the body, the crank arm 14 displaces and rotates drive member 16 in a first direction approximately coaxially aligned with first joint 38 (i.e. counterclockwise-CCW) while simultaneously rotating driven member 20 in a second, opposing direction approximately coaxially aligned with a second joint 40 (i.e. clockwise-CW), this causes the cam 22 to rotate in the same direction as the driven gear. The cam 22 is fixedly connected to a cable 46. The cable is directed by pulleys 48 to a weight which is raised to resist the movement. The user then retracts the legs reversing these rotational directions of the drive 16 and driven 20 members and cam 22 to lower the weights 50.

In one embodiment, the cable connection to cam 22 can be selectively changed by the user to not only secure to various positions around the periphery of cam 22, but also to reverse the rotation of the cam to apply force in an opposite exercise direction.

A selectable cable pin within the perimeter of the cam may allow the exerciser to select the stretched position angle of the squat to be increased or decreased while keeping the variable cam properly aligned to the movement of the machine.

Force applied by the user while first joint 38 (CCW) and second joint 40 (CW) rotate will cause pivot shaft 30 and drive member 16 to displace toward the front of exercise machine 10. Pivot shaft 30 and drive member 16 will track in position and rotation approximately coaxially with first joint 38. The displacement and rotation (CCW) of drive member 16 causes opposing rotation (CW) of driven member 20 and thus, cam 22. Such rotation of driven member 20 is in the opposing direction relative to the rotation of first joint 38, and simultaneously tracks the same direction of rotation of second joint 40. While the legs retract, first joint 38 rotates (CW), second joint rotates (CCW), drive member 16 displaces toward the rear of exercise machine 10 while rotating (CW), causing driven member 20 and cam 22 to rotate (CCW).

Exercise machine 10 further includes a frame 42 to provide structural support. Pivot shaft 36 is pivotably connected to frame 42. In one embodiment, this pivotal connection is achieved by bearings via pivot shaft 36 and first and second pivot support posts 67, 68. Frame 42 includes a body support 44 to support portions of the user's body during operation of exercise machine 10. In the embodiment illustrated, the body support is inclined at a forty five degree angle, however a lesser angle of approximately thirty degrees would allow the use of a lever release sliding seat. This would provide a way to adjust the height of the shoulder pads to fit various users, as well as making it easier to enter, get into position prior to the exercise, and comfortably exit the machine. Frame 42 also provides housing and support for opposition system 24.

In one embodiment, opposition system 24 includes a cable 46, one or more pulleys 48, and one or more free weights 50. Free weights 50 are added or adjusted by the user to the desired load to be utilized during the exercise. A selectorized weight stack can be substituted for free weights to increase ease and efficiency in changing weights. Cam 22 is operatively connected to a first end 52 of cable 46, and the cable is operatively connected via pulleys 48 to free weights 50 at a second end 54. Cable 46 is configured to wind and unwind around cam 22 as the cam and driven member 20 rotate. Although a circular shape cam is illustrated, in an alternative embodiment, an irregular shape cam, such as those developed by Arthur Jones and Nautilus, can be substituted to more accurately match the resistance to the strength curve of the muscles involved in the movement.

For the squat exercise, cable 46 is attached such that the cable begins to wind onto cam 22 as the legs extend. During the exercise, the desired weights 50 are moved generally linearly from the bottom toward the top of the frame and in the reverse as the legs retract. Thus, linear resistance from weights 50 is converted through cable 46 to rotational resistance at cam 22 and pivot shaft 36 and driven member 20.

In a preferred embodiment, the diameter ratio is 1:1, such that drive and driven members 16, 20 are of equal diameter. In one embodiment, drive gear 16 and driven gear 20 are substantially 16 inches in diameter.

Figure 10:
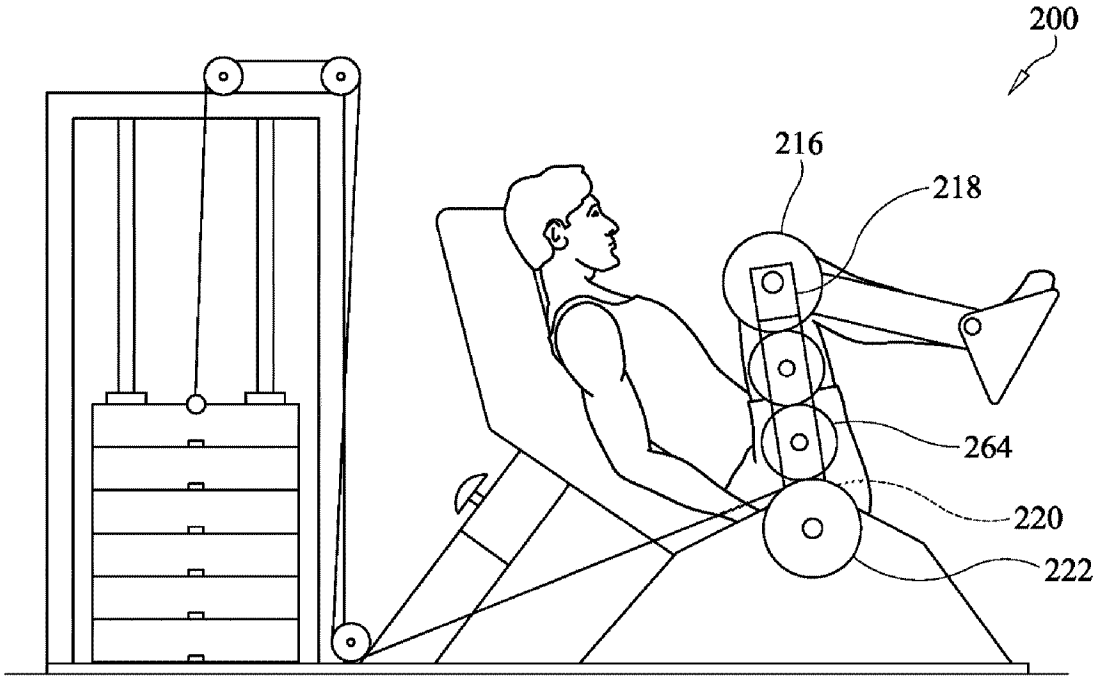
FIG. 10 depicts a schematic diagram of idler gears utilized in the gear train according to an alternative embodiment of the present invention.
Figure 11:
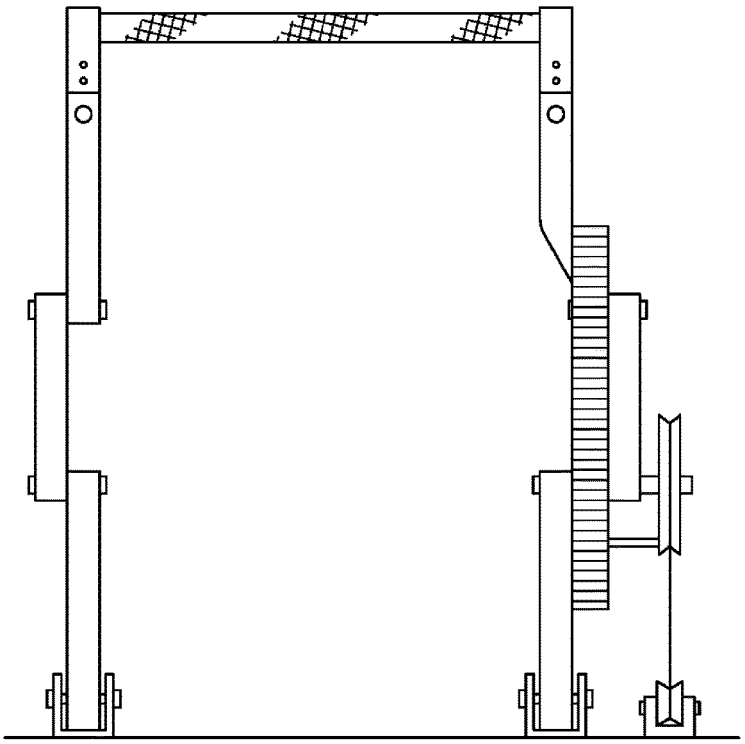
FIG. 11 depicts a front elevation view of an exercise machine in an alternative embodiment.

For compound exercises involving a plurality of the user's joints, multiple members (i.e. gears) can be used as required to match the opposition system resistance to the exercise movement. Although only two members, (drive and driven gears), have been described in some embodiments, any even number of intermediate idler members (i.e. gears) can be added without changing the relative movement of the input/drive and output/driven gear (e.g. FIG. 10). Referring to FIG. 10, an alternative exercise machine 200 is shown. Exercise machine 220 includes drive member 216, adjustable connecting arm 218, driven member 220, cam 222, and a pair of idler gears 264. Idler gears would allow for a lower profile machine. Also, certain compound exercises may involve more than two joints providing force against the resistance load which may require additional gears to match the resistance to the movement of the body. Additionally, idler gears can be configured to pivot in and out (of the gear train) to allow for length adjustments of the distance between the user's joints—such as the knee and hip. The connecting arm connecting the gears could be adjustable to accommodate idler gears. Additionally, the drive and driven gears could be reversed and the cam could be mounted to any gear (proximal, distal or idler, see FIG. 11).

Although the drive and driven members 16, 20 and cam 22 are shown as full circular disks in shape, partial members and cams may be used. Those of skill in the art will appreciate that the shape of the member is dictated by the range of motion desired.

Counterweights are used in some embodiments to properly position the apparatus during non-use and to minimize the force exerted by the user needed to lift the equipment itself. In other words, the user's force expended should be directed to the exercise itself, as opposed to holding the equipment up. For example, during a squat movement, as the legs are extended (e.g. FIG. 2), the user would have to fight gravity to hold the machine in the desired position throughout the motion of the exercise where it not for the counterweights providing the necessary force. Although shown as three separate counterweight systems (FIGS. 1-6), alternatively, one counterweight can be used with a second system of cables and pulleys to achieve the same balancing effect.

In one embodiment, a first counterweight 56 is operatively connected to engagement member 12 adjacent to pivot 28 and prevents the tendency of the plate to rotate to the horizontal position rather than to follow the movement of the user. As depicted, counterweight 56 comprises a shaft with a weight attached thereto. Those of skill in the art will appreciate that the shaft length, as well as the position of the weight or weights on the shaft, can be varied to achieve the desired balance. A second counterweight 58 is operatively connected to pivot shaft 30 to counter balance engagement member 12 and crank arm 14. A third counter weight 60 is operatively connected to connecting arm 18 on the end of the connecting arm, proximate end 34, to balance drive gear 16, crank arm 14, and engagement member 12. In other words, second and third counterweights 58, 60 serve to lessen the force exerted by the user necessary to lift the weight of engagement member 12, crank arm 14, connecting arm 18, and drive and driven members 16, 20, so that the user's force is directed more to the compound exercise movement and opposing force rather than the weight of the equipment.

In an alternative embodiment (e.g. FIGS. 7A, B), the distance between pivot shafts 30 & 36 is adjustable. Meshed gears are not used in this embodiment. Rather, chains, sprockets, belts or pulleys are used so that drive member 16 and driven member 20 can be moved closer or further apart relative to each other. As such, the axis to axis distance between drive and driven members 16, 20 can be adjustable so as to be scalable to fit different sized users. For example, a user with a long femur can lengthen the distance between drive and driven members 16, 20.

Exercise machine 10 can be made from steel, or any other material have similar strength and rigidity characteristics, including but not limited to metal, carbon fiber, composite, some types of wood or plastic, or combinations thereof. Frame 42 can be made of wood, metal, or other materials having suitable strength and rigidity characteristics. Preferably, the movable load bearing portions are constructed of metal. Various safety features can be added to protect users and bystanders from moving parts, such as gear or chain guards. These guards may be connected to move with the displacement of the drive gear by being fixed to the connecting arm 18 which is operatively connected to both drive 16 and driven 20 members. Additionally, a rotation limiter can be added to engagement member 12 to limit pivot rotation to the range useful in the exercise. A rubber bumper may be added to surround the engagement member around the edges. A wedge or stop may also be added to drive 16 and driven 20 members to prevent over rotation beyond fully extended. Further, handles may be added to body support 44 to assist user in using, entering and exiting the machine.

Although the embodiments shown depict a squat exercise machine, the mechanism can be configured for use in other embodiments of compound exercise machines, cardio exercise machines, and human powered machines. Other compound exercise machines can include, without limitation, lunges, bench press, incline bench press, overhead press, dips, pull down, row, upright rows, hand gripper, and abdominal machines. Cardio exercise machines using compound exercise movements can include without limitation, steppers, and or upper body cardio exercisers providing an alternating push/pull arm movement. Human powered machines may include a 2, 3, or 4 wheel bike with chains and sprockets instead of gears.

Selectorized weight stacks, known to those of skill in the art for speed and efficiency of changing weight, are possible. Plate loaded (a.k.a. hand stacked free weights) can also be used. The invention is not limited to this method of resistance however, as any form of exercise resistance could be used such as springs, elastic bands or tubing, flexible rods, flywheels, electromagnetic, hydraulic or pneumatic, weights suspended by pivoting leverage arms, either separated or directly attached to the driven axis of machine, or other parts of machine, or other forms of resistance known.

The foregoing description of the invention has been presented for purposes of illustration and to provide an example of a complete embodiment of the apparatus. It is neither intended to be exhaustive nor to limit the invention to the precise form disclosed. It will be understood by those skilled in the art that changes in form and detail thereof can be configured into many other embodiments without departing from the scope of the claims of the invention. It will be understood that many of the particulars may have other methods to achieve substantially the same results well known to those familiar with the art. Accordingly this invention is intended to embrace all alternatives, modifications, and variations that fall within the spirit and broad scope of the claims.

What is claimed is:

1. An exercise machine comprising:

at least two cooperating members, the at least two cooperating members including a first cooperating member and a second cooperating member, the first cooperating member configured to be approximately coaxially aligned with a first human joint of a user, and the second cooperating member configured to be approximately coaxially aligned with a second human joint of the user;

wherein each of said first and second cooperating members provides rotational resistance during a compound exercise movement;

an engagement member connected to a crank arm, the crank arm being operatively connected to the first cooperating member, the engagement member moving in a substantially linear path during the compound exercise movement; and the second cooperating member being operatively connected to an opposing force;

wherein the first cooperating member and the second cooperating member are synchronized so as to resist movement in opposite directions relative to each other for the exercising of at least two different muscle groups of the user simultaneously.

2. The exercise machine of claim 1 wherein the second cooperating member being operatively connected to an opposing force further comprises:

a cam operatively connected to the second cooperating member, the cam being operatively connected to a cable-pulley weight assembly.

3. The exercise machine of claim 2 further comprising:

the cam being an eccentric cam.

4. The exercise machine of claim 1 further comprising:

a first counterweight operatively connected to the first cooperating member;

a second counterweight operatively connected to the second cooperating member.

5. The exercise machine of claim 1 further comprising:

the first and second cooperating members being adjustable with respect to each other so as to be scalable to fit different users.

6. The exercise machine of claim 1 further comprising:

wherein the first human joint with which the first cooperating member is configured to be approximately coaxially aligned comprises a human knee;

wherein the second human joint with which the second cooperating member is configured to be approximately coaxially aligned comprises a human hip.

7. An exercise machine comprising:

a drive member and a driven member, each said member configured to be approximately coaxially aligned with a respective human joint of a user, to provide opposing rotational resistance during a compound exercise movement for the exercising of at least two different muscle groups of the user simultaneously;

the drive member and the driven member rotating relative to each other in a synchronized and an opposing manner;

an engagement member connected to a crank arm, the crank arm being operatively connected to the drive member, and the engagement member moving in a substantially linear path during the compound exercise movement;

the driven member being operatively connected to a cam, the cam being substantially coaxial with the driven member; and the cam being operatively connected to a cable, the cable being operatively connected to one or more weights or pulleys.

8. The exercise machine of claim 7 further comprising:

the drive member and the driven member being adjustable with respect to each other so as to be scalable to fit different users.

9. The exercise machine of claim 7 further comprising:

the drive member configured to be approximately coaxially aligned with a first human joint;

the driven member configured to be approximately coaxially aligned with a second human joint.

10. The exercise machine of claim 7 further comprising:

the drive member configured to be coaxially aligned with a human knee;

the driven member configured to be approximately coaxially aligned with a human hip.

11. An exercise machine comprising:

a drive gear engaged with a driven gear, each said gear configured to be approximately coaxially aligned with a respective human joint of a user, to provide opposing rotational resistance during a compound exercise movement for the exercising of at least two different muscle groups of the user simultaneously;

the drive gear being pivotably connected to a first end of a connecting arm;

the driven gear being pivotably connected to a second end of the connecting arm;

an engagement member connected to a crank arm, the crank arm being fixedly connected to the drive gear, and the engagement member moving in a substantially linear path during the compound exercise movement;

the driven gear being operatively connected to a cam, the cam being substantially coaxial with the driven gear; and the cam being operatively connected to a cable, the cable being operatively connected to one or more weights or pulleys.

12. An exercise machine comprising:

first and second cooperating members, at least one of which configured to be approximately coaxially aligned with a respective human joint of a user, the first and second cooperating members being synchronized and rotating in opposite directions during a compound exercise movement for the exercising of at least two different muscle groups of the user simultaneously; and an engagement member connected to a crank arm, the crank arm being operatively connected to one of the first or second cooperating members, the other of said first or second cooperating members being operatively connected to an opposing force, and the engagement member moving in a substantially linear path during the compound exercise movement.

13. The exercise machine of claim 12 further comprising:

the engagement member being free to move in two axes during the compound exercise movement.

14. An exercise machine for performing a compound exercise, comprising:

a frame;

a user support structure supported on the frame;

a drive member pivotal relative to the frame about a drive axis, the drive member configured to be approximately coaxially aligned with a distal body joint of a user;

a driven member pivotal relative to the frame about a driven axis, the driven member configured to be approximately coaxially aligned with a proximal body joint of the user;

a connecting arm operatively connecting the drive member and the driven member;

an engagement member connected to a crank arm, the crank arm connected to the drive member, the engagement member moving in a substantially linear path between a retracted position and an extended position of the exercise machine;

the driven member connected to a cam, the cam connected to a resistance weight;

a first counterweight balancing the exercise machine at the drive axis; and a second counterweight balancing the exercise machine at the driven axis;

wherein the drive member and the driven member are synchronized so as to resist movement in opposite directions relative to each other for the exercising of at least two different muscle groups of the user simultaneously.

15. The exercise machine of claim 14, wherein the exercise machine is configured for a leg squat exercise of the user, and wherein the proximal body joint of the user is a human hip, and the distal body joint of the user is a human knee.

* * * * *